US008322804B2

(12) United States Patent
Kim

(10) Patent No.: US 8,322,804 B2
(45) Date of Patent: Dec. 4, 2012

(54) CONTAINER ELEVATING APPARATUS IN A DOOR REFRIGERATOR

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 12/634,498

(22) Filed: Dec. 9, 2009

(65) Prior Publication Data

US 2010/0175414 A1 Jul. 15, 2010

Related U.S. Application Data

(60) Provisional application No. 61/145,057, filed on Jan. 15, 2009.

(51) Int. Cl.
*A47B 96/04* (2006.01)

(52) U.S. Cl. ..... 312/405.1; 312/321.5

(58) Field of Classification Search ..... 312/404, 312/405, 405.1, 408, 321.5; 62/449, 440, 62/337; 108/25, 27, 102–103, 94
See application file for complete search history.

(56) References Cited

U.S. PATENT DOCUMENTS

| | | | | |
|---|---|---|---|---|
| 2,694,906 | A * | 11/1954 | Didion | 62/326 |
| 2,898,173 | A * | 8/1959 | Squire | 312/248 |
| 3,610,174 | A * | 10/1971 | Kesling | 108/56.1 |
| 4,186,978 | A * | 2/1980 | Thomson | 312/321.5 |
| 6,742,855 | B2 * | 6/2004 | Whitaker et al. | 312/405.1 |
| 6,905,183 | B2 * | 6/2005 | Leimkuehler et al. | 312/405.1 |
| 6,962,116 | B2 * | 11/2005 | Bienick et al. | 108/108 |
| 7,469,553 | B2 * | 12/2008 | Wu et al. | 62/344 |
| 7,552,983 | B2 * | 6/2009 | Shin | 312/405.1 |
| 8,042,892 | B2 * | 10/2011 | Benz et al. | 312/408 |
| 2003/0080661 | A1 * | 5/2003 | Ahmed et al. | 312/405.1 |
| 2004/0012314 | A1 * | 1/2004 | Hay et al. | 312/405.1 |
| 2004/0178711 | A1 * | 9/2004 | Avendano | 312/405.1 |
| 2004/0255607 | A1 * | 12/2004 | Barmann et al. | 62/407 |
| 2008/0030114 | A1 * | 2/2008 | Becke | 312/408 |

* cited by examiner

*Primary Examiner* — Hanh V Tran
(74) *Attorney, Agent, or Firm* — Birch, Stewart, Kolasch & Birch, LLP

(57) ABSTRACT

Provided is a container mounted on a refrigerator door to be capable of being elevated, where the container can be raised or lowered through a user's manipulation when mounted on the rear of a door.

9 Claims, 5 Drawing Sheets

CONTAINER ELEVATING APPARATUS IN A DOOR REFRIGERATOR

This Non-Provisional application claims priority under 35 U.S.C. 119(e) on U.S. Provisional Application No. 61/145,057, filed on Jan. 15, 2009, the entire contents of which are hereby incorporated by reference.

THE BACKGROUND

1. The Field

The present invention relates to a refrigerator door.

2. Description of the Related Art

In general, a refrigerator is a household appliance for storing food at low temperatures over extended periods.

Specifically, depending on the locations of their refrigeration compartments and freezer compartments, refrigerators can be categorized into top mount refrigerators having the freezer compartment provided at the top, bottom freezer refrigerators having the freezer compartment provided at the bottom, and side by side refrigerators having the refrigeration compartment and freezer compartment arranged to the left and right of each other.

Also, a plurality of shelves on which food is placed, and box-shaped drawers open at the top for storing vegetables or fruit may be provided inside a refrigerator. In addition, an ice maker may be installed in the freezer compartment or refrigeration compartment, or on the rear of a door. Further, depending on the product, a dispenser for dispensing water or ice may be provided on the front of a refrigerator door, and a home bar structure may be provided on a refrigerator door to allow storage and removal of beverages or containers filled with water without opening the refrigerator door.

Additionally, one or more container(s) in which food or vessels are stored may be mounted to the rear of a door.

THE DETAILED DESCRIPTION

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

A detailed description will be provided below on a refrigerator door and a container mounted on the refrigerator door to be capable of being elevated. While the drawings do not illustrate the structure of a refrigerator, a refrigerator configured according to the scope of the present invention includes a body defining a refrigeration compartment and/or a freezer compartment within, a door provided to be capable of pivoting at the front of the body, and a compressor, condenser, evaporator, and expansion member provided below the rear wall of the body. Also, the refrigerator door described below may be a refrigeration compartment door that opens and closes a refrigeration compartment, and may be a freezer compartment door that opens and closes a freezer compartment.

Figure 1:
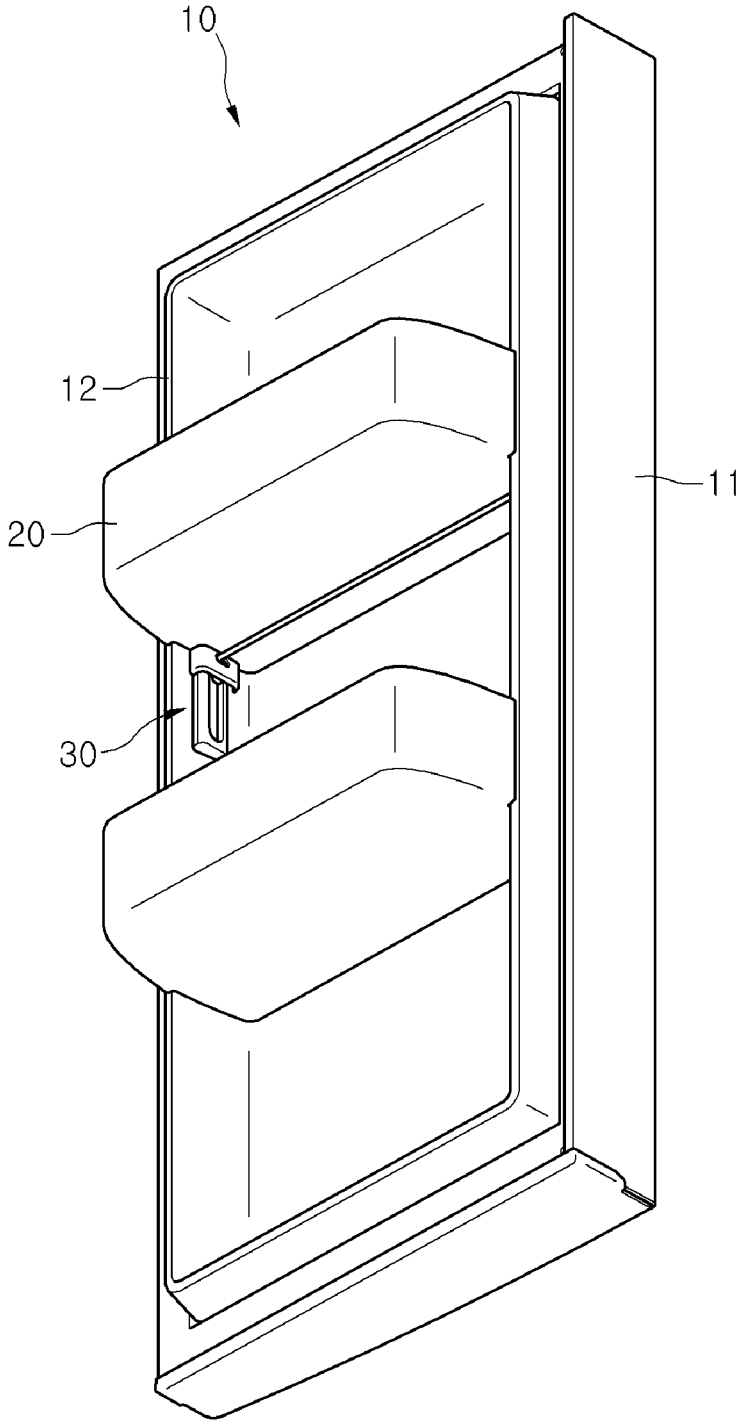
FIG. 1 is a rear perspective view of a refrigerator door provided with a container capable of elevating according to embodiments of the present invention.

FIG. 1 is a rear perspective view of a refrigerator door provided with a container capable of elevating according to embodiments of the present invention.

Referring to FIG. 1, a refrigerator door 10 provided with an elevating container according to embodiments of the present invention includes an outer cover 11 exposed to the outside, and an inner cover 12 coupled to the rear surface of the outer cover 11. Also, an insulating member is filled between the outer cover 11 and the inner cover 12. As shown, the wall projects rearward at the edges of the inner cover 12, and a space is defined into the wall. The space defined into the inner cover 12 houses food or vessels.

In addition, the space in the wall has a plurality of containers 20 mounted therein, and the containers 20 are open at the top so that food can be placed in the containers 20. Further, the containers 20, while mounted to the inner cover 12, are capable of being raised and lowered. For the sake of convenience, of the walls of the inner cover 12, the left side and the right side portions projecting at the edges will be referred to as sidewalls.

Also, a handle 201 (in FIG. 3) is formed below the container 20 to facilitate elevating of the container 20 by a user.

In detail, an elevating apparatus 30 is provided on a side surface of the container 20 and a sidewall of the inner cover 12, and the elevating apparatus 30 enables the container 20 to be moved a predetermined distance upward and downward. Here, the surface of the container 20 side surfaces that is close to the inner cover 12 will be defined as a rear surface, the opposite portion (that is, the surface exposed to the inside of the refrigerator) will be defined as the front surface, and the portions connecting the front surface and the rear surface will be defined as side surfaces.

Figure 2:
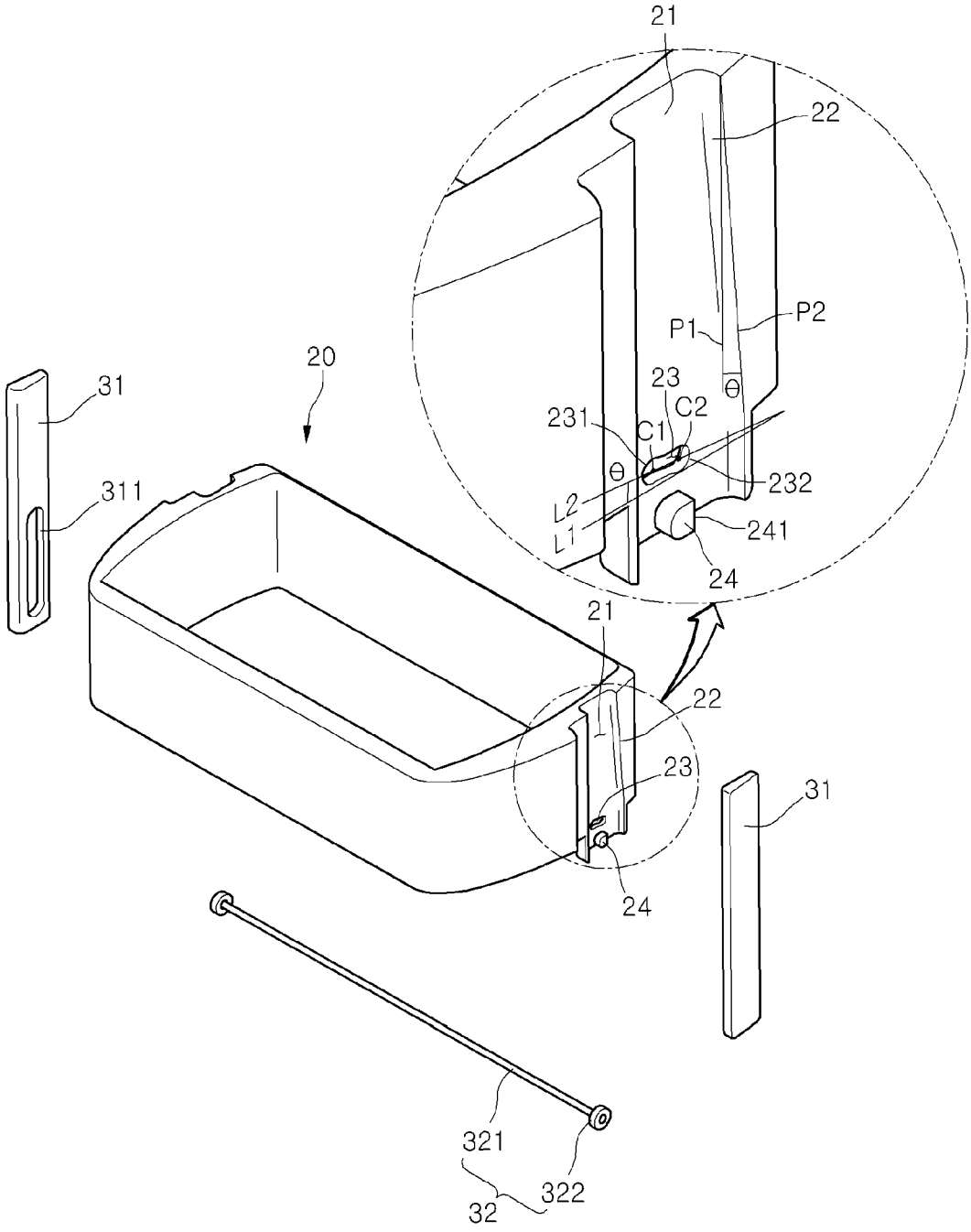
FIG. 2 is an exploded perspective view showing the structure of a container and an elevating apparatus according to embodiments of the present invention.
Figure 3:
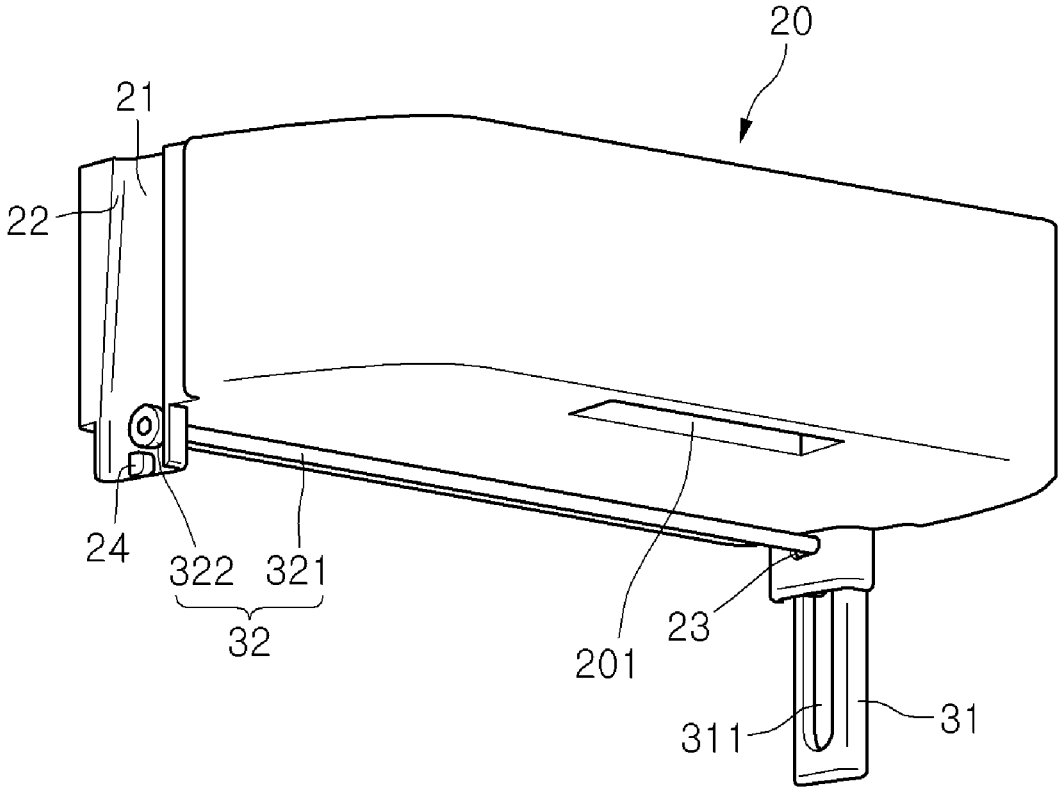
FIG. 3 is a bottom perspective view of a container.

FIG. 2 is an exploded perspective view showing the structure of a container and an elevating apparatus according to embodiments of the present invention, and FIG. 3 is a bottom perspective view of a container.

Referring to FIGS. 2 and 3, an elevating apparatus 30 is coupled to either side surface of a container 20 mounted on the rear surface of a refrigerator door.

In detail, a guide block 31 is provided on either side surface of the inner cover 12 to guide movement of the container 20. The guide block 31 may be provided as a separate component and mounted to either side surface of the inner cover 12, or the guide block 31 may be injection molded with the inner cover 12.

Also, a block receiving portion 21 is formed recessed in a portion of the side surfaces of the container 20 closer to the rear surface, in order to receive the guide block 31. Further, a roller member 32 is provided on the undersurface of the container 20 to smoothly raise or lower the container 20. In detail, the roller member 32 is formed with a shaft 321 that extends across the undersurface of the container 20, and a roller 322 is coupled at either end of the shaft 321. Also, in order for the shaft 321 to pass through, the block receiving portion 21 defines a shaft hole 23, and a stopper 24 projects below the shaft hole 23. The roller 322 not only guides the raising and lowering of the container 20 smoothly, but also functions as a stopper to retain the container 20 in a fixed state at rest. The stopper 24 also retains the container 20 in a fixed state at rest. A vertically flat pressing surface 241 is formed on the rear surface of the stopper 24.

A guide slot 311 defining an inner surface of the guide block 31, in which the roller 322 and the stopper 24 are received, is defined in a lengthwise direction of the guide block 31. In detail, the roller 322 rises or descends while rolling along the guide slot 311. With the container 20 in a stopped state, the stopper 24 is pressed against the side surface of the guide slot 311. Here, the elevating apparatus 30 may be defined as including the guide block 31, roller member 32, and a stopping device, and the stopping device may be defined to include at least the stopper 24. A description on the operation of the elevating apparatus will be provided in further detail below with reference to the diagrams.

A sidewall 22 of the block receiving portion 21 is formed to have a slope of a predetermined angle—that is, an angle θ is formed between line P2 traversing the sidewall at the rear surface of the container 20 and progressively deviating rearward from vertical line P1 in a downward direction. This is to contribute to the elevating operation of the container 20, and in order to raise or lower the container 20, the front surface of the container 20 is slightly lifted, after which the container 20 is raised or lowered. Accordingly, when the front of the container 20 is lifted, the sidewall 22 of the block receiving portion 21 is pressed against the side surface of the guide block 31. Conversely, when the container 20 is in a vertically still state, the sidewall 22 is separated from the guide block 31.

The shaft hole 23 is formed of a front inner periphery 231 and a rear inner periphery 232, and the front inner periphery 231 and the rear inner periphery 232 are formed in circular shapes so that the shaft 231 can be pressed against them. Also, as shown, line L2 connecting the radial center C1 of the curvature of the front inner periphery 231 and the radial center C2 of the curvature of the rear inner periphery 232 is offset by a predetermined angle θ from a horizontal line L1. As described above, this offset is related to the lifting operation of the container 20. That is, with the container 20 in a horizontally still state, the shaft 321 is pressed against the front inner periphery 231, and with container 20 in a lifted state to be raised or lowered, the shaft 321 is pressed against the rear inner periphery 232.

Figure 4:
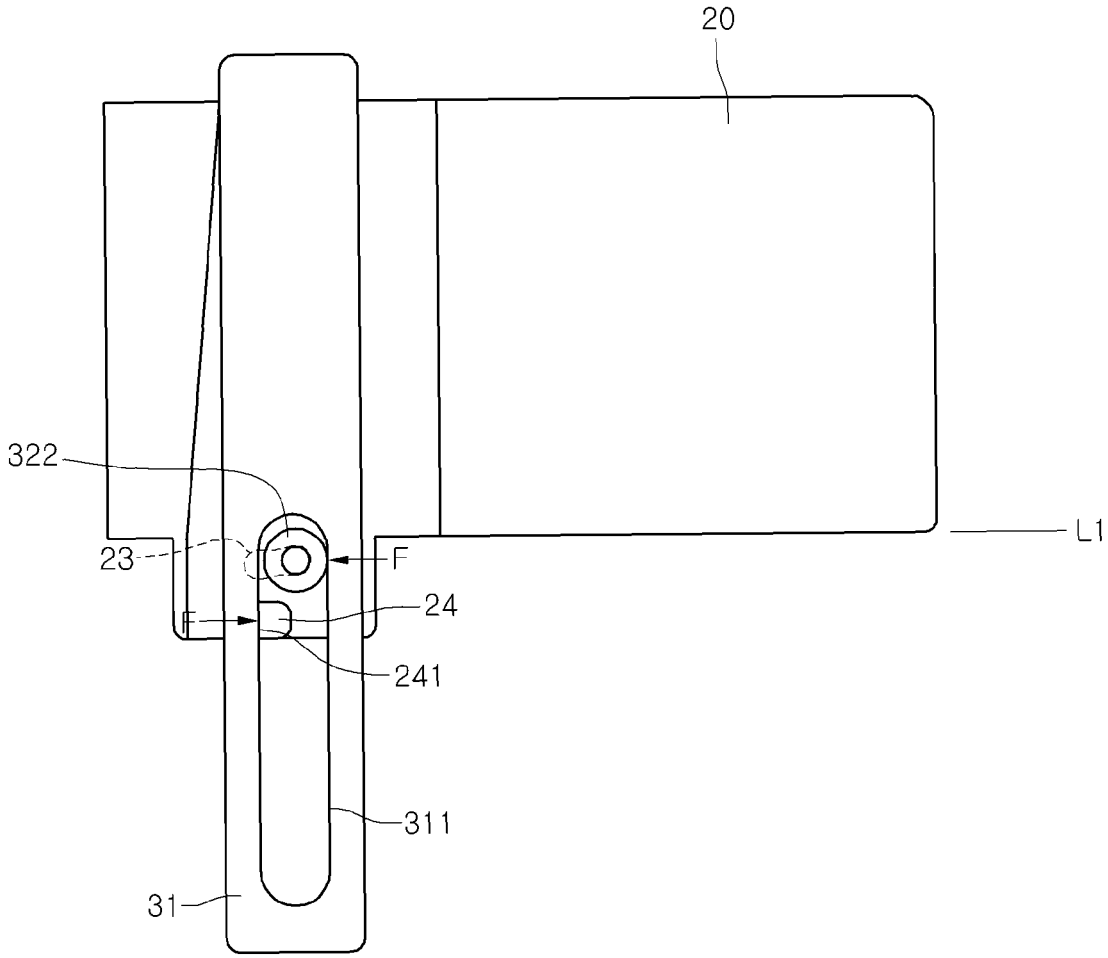
FIG. 4 is a side view showing a container stopped and maintained in a horizontal state according to embodiments of the present invention.

FIG. 4 is a side view showing a container stopped and maintained in a horizontal state according to embodiments of the present invention.

Referring to FIG. 4, the container 20 is maintained in a horizontal state when still, and the pressing surface 241 of the stopper 24 is pressed against the side surface of the guide slot 311. Also, the shaft 321 of the roller member 32 is pressed against the front inner periphery 231. Thus, the roller 322 of the roller member 32 is pressed against the side surface of the guide slot 311 to function as a stopper. Furthermore, the roller 322 is pressed against a side surface opposite the side surface of the guide slot 311 that the pressing surface 241 is pressed against. Thus, a resisting force F is applied respectively to the pressing surface 241 and the roller 322 to generate pressing force, and through the pressing force, the container 20 is maintained in a fixed state.

Here, in order to increase friction between the roller 322 and the guide slot 311, a pad of a rubber material (for example) may be further provided on the roller 322 and/or the guide slot 311. Alternatively, recesses may be formed correspondingly in the roller 322 and the guide slot 311, so that the roller 322 can be maintained in a state engaged to the guide slot 311. Means for increasing friction between the roller 322 and the guide slot 311 according to present embodiments shall not be limited to the examples described above.

Further, with the container 20 in a still state, the guide block 31 is in surface contact with another sidewall opposite the sidewall 22 of the block receiving portion 21—that is, the sidewall that extends vertically. Accordingly, the contacting surface functions to prevent gravitational descent of the container 20 to a certain degree.

Figure 5:
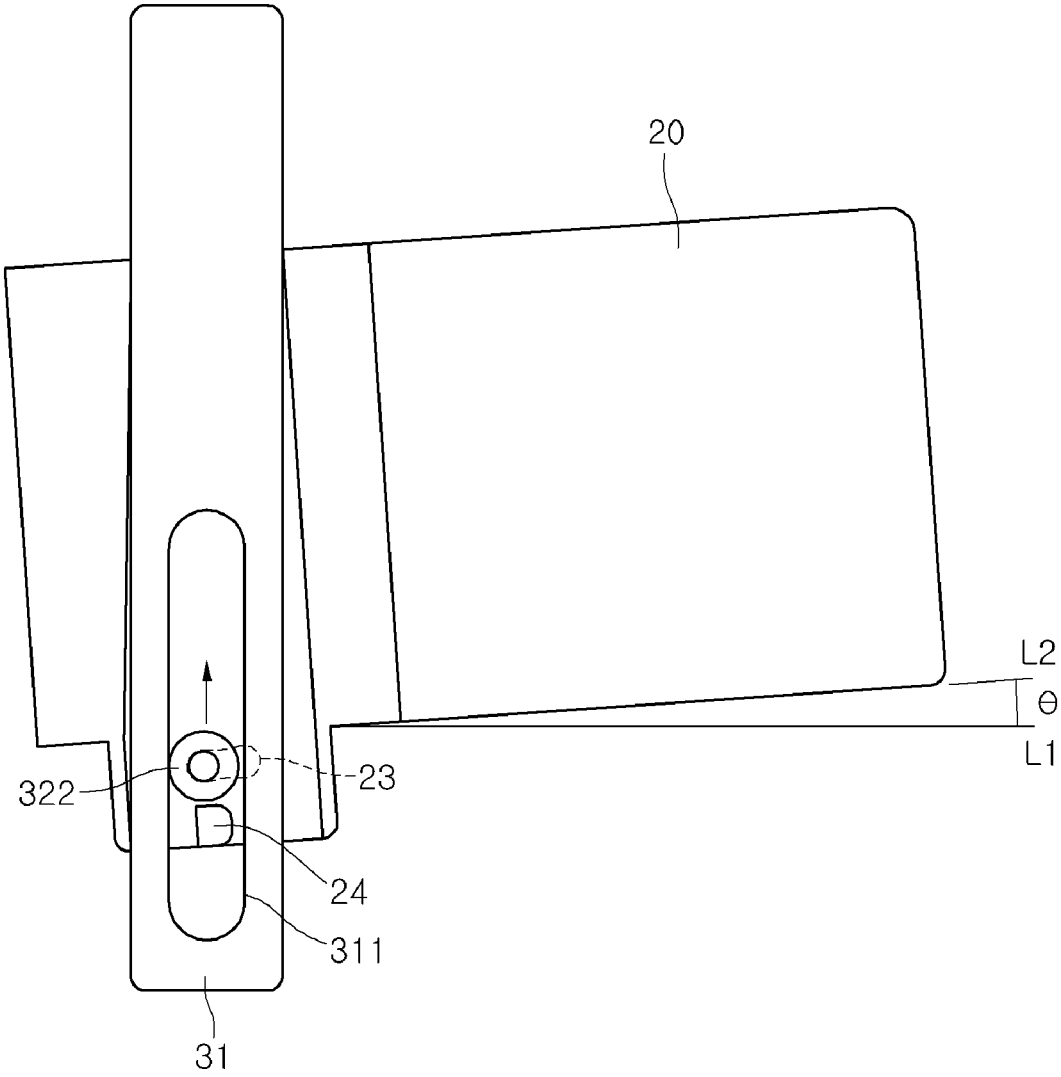
FIG. 5 is a side view showing a container in a lifted state for the purpose of being raised or lowered according to embodiments of the present invention.

FIG. 5 is a side view showing a container in a lifted state for the purpose of being raised or lowered according to embodiments of the present invention.

Referring to FIG. 5, when the front of the container 20 is lifted slightly, the guide block 31 contacts both the top and bottom of the sidewall 22 of the block receiving portion 21. In the diagram, being configured to vertically extend from a point separated upward from the bottom of the sidewall, the guide block contacts both the top and bottom of the sidewall 22. Accordingly, during movement of the container 20, contact between the guide block 31 and the guide slot 311 is minimized to minimize resistance to movement.

When the front of the container 20 is lifted, the pressing surface 241 of the stopper 24 is separated from the side surface of the guide slot 311, and the shaft 321 of the roller member 32 is pressed against the rear inner periphery 232 of the shaft hole 23. Then, the roller 322 of the roller member 32 is pressed against the side surface of the guide slot 311 opposite the surface of contact when in a still state. In this state, when the container 20 is lifted or lowered, the roller 322 rolls upward or downward along the side surface of the guide slot 311. Thus, the container 20 is raised or lowered by the distance by which the roller 322 travels to the top and bottom of the guide slot 311.

What is claimed is:

1. A refrigerator comprising:

a body having a door, the door having a pair of side walls;

a pair of guide blocks on the inner surface of the door;

a guide slot formed in each of the pair of guide blocks, each guide slot having opposed side surfaces;

a basket disposed on the door between the pair of side walls, the basket having a bottom and a pair of sidewalls, the basket movable between a level position and a tilted position;

a block receiving portion in each side wall of the basket, the guide blocks fitting within the block receiving portions; and a stopper projecting from each block receiving portion, each stopper engaging one of the slot side surfaces when the basket is in the level position.

2. The refrigerator of claim 1, further comprising:

a roller extending from each side of the basket, the roller engaging one of the slot side surfaces when the basket is in the level position.

3. The refrigerator of claim 2, further comprising:

a shaft hole formed in each block receiving portion; and a shaft connecting the rollers, the shaft extending through the shaft holes.

4. The refrigerator of claim 3, wherein the shaft contacts an edge of the shaft hole when the basket is in the level position.

5. The refrigerator of claim 3, wherein the shaft hole has two ends, and an axis extending through the center of the two ends is at an angle to a horizontal axis when the basket is in the level position.

6. The refrigerator of claim 5, wherein the block receiving portion has a rear surface, the rear surface extending rearwardly as it extends downwardly.

7. The refrigerator of claim 1, wherein the stopper has a flat rear surface contacting said one of the slot side surfaces of the guide slot.

8. The refrigerator of claim 1, wherein the block receiving portion has a rear surface, the rear surface extending rearwardly as it extends downwardly.

9. The refrigerator of claim 1, further comprising a handle in the bottom of the basket.

* * * * *

UNITED STATES PATENT AND TRADEMARK OFFICE

CERTIFICATE OF CORRECTION

PATENT NO. : 8,322,804 B2
APPLICATION NO. : 12/634498
DATED : December 4, 2012
INVENTOR(S) : Seong Wook Kim It is certified that error appears in the above-identified patent and that said Letters Patent is hereby corrected as shown below:

ON THE TITLE PAGE and IN THE SPECIFICATION:

At item (54) of the Title Page and at column 1, lines 1-2, correct the title of the invention to read as follows:

--CONTAINER ELEVATING APPARATUS IN A DOOR FOR REFRIGERATOR--.

Signed and Sealed this
Twelfth Day of March, 2013

Teresa Stanek Rea
*Acting Director of the United States Patent and Trademark Office*